United States Patent [19]

Staats

[11] 4,329,557

[45] May 11, 1982

[54] MICROWAVE OVEN WITH IMPROVED ENERGY DISTRIBUTION

[75] Inventor: James E. Staats, Louisville, Ky.

[73] Assignee: General Electric Company, Louisville, Ky.

[21] Appl. No.: 101,342

[22] Filed: Dec. 7, 1979

[51] Int. Cl.[3] ..... H05B 6/74

[52] U.S. Cl. ..... 219/10.55 F; 219/10.55 A; 219/10.55 E

[58] Field of Search ..... 219/10.55 F, 10.55 R, 219/10.55 E, 10.55 D, 10.55 A, 10.55 M

[56] References Cited

U.S. PATENT DOCUMENTS

| | | | |
|---|---|---|---|
| 2,909,635 | 10/1959 | Haagensen | 219/10.55 F |
| 2,920,174 | 1/1960 | Haagensen | 219/10.55 F |
| 3,081,392 | 3/1963 | Warner | 219/10.55 F |
| 3,210,511 | 10/1965 | Smith | 219/10.55 F |
| 3,265,780 | 8/1966 | Long | 219/10.55 F |
| 3,320,396 | 5/1967 | Boehm | 219/10. 55 F |
| 3,439,143 | 4/1969 | Cougoule | 219/10.55 F |
| 3,461,260 | 8/1969 | Bremer | 219/10.55 F |
| 3,692,967 | 9/1972 | Hashimura | 219/10.55 F |
| 3,746,823 | 7/1973 | Whiteley | 219/10.55 F |
| 3,810,248 | 5/1974 | Risman et al. | 219/10.55 F |
| 4,019,009 | 4/1977 | Kusonoki et al. | 219/10.55 F |
| 4,080,524 | 3/1978 | Greenfield, Jr. et al. X | 219/10.55 F |
| 4,122,323 | 10/1978 | Staats | 219/10.55 D |

*Primary Examiner*—B. A. Reynolds
*Assistant Examiner*—Philip H. Leung
*Attorney, Agent, or Firm*—H. Neil Houser; Radford M. Reams

[57] ABSTRACT

A microwave cooking appliance having bypass waveguides oriented vertically within the cooking cavity to more evenly distribute microwave energy. The waveguides are supported from the sidewalls of the cavity and are provided with slots for supporting a food holding shelf. Microwave energy is introduced into the cavity through a feed aperture in the top wall and an energy directing plate is arranged opposite the opening to direct microwave energy toward the bypass waveguides.

9 Claims, 2 Drawing Figures

MICROWAVE OVEN WITH IMPROVED ENERGY DISTRIBUTION

BACKGROUND OF THE INVENTION

1. Field of the Invention

This application is directed to microwave ovens and, more specifically, to microwave ovens which incorporate means for more evenly distributing microwave energy within the oven enclosure, thereby resulting in more even heating and cooking of food prepared in the oven.

2. Description the Prior Art

One well known problem associated with conventional microwave ovens concerns the uneven distribution of microwave energy within the cooking cavity. The result of such unevenness has been the creation of "hot spots" and "cold spots" at different finite areas of the oven. For many types of foods, cooking results are unsatisfactory under such conditions because some portions of the food may be completely cooked while others are barely warmed.

One explanation for the non-uniform cooking pattern is that electromagnetic standing wave patterns, known as "modes, " are set up within the cooking cavity. When such a standing wave pattern is set up, the intensities of the electric and magnetic fields vary greatly with position. The precise configuration of the standing wave or mode pattern during a cooking cycle is dependent on a multitude of factors among which are the characteristics of the microwave energy source of the dimensions and makeup of the cavity and the loading effect of different types and quantities of food which are placed in the cooking cavity.

In an effort to alleviate the problem of non-uniform energy distribution, a great many approaches have been tried with varying degrees of success. The most common approach involves the use of a so-called "mode stirrer" which typically resembles a fan having metal blades. The mode stirrer rotates and may be placed either within the cooking cavity itself (usually protected by a cover constructed of a material transparent to microwave energy) or, to conserve space within the cooking cavity, may be mounted within a recess formed in one of the cooking cavity walls, normally the top.

The function of the mode stirrer is to continually alter the mode pattern within the cooking cavity. If a particular mode exists for only a short time period, if different hot and cold spots are associated with each mode, then, energized over a period of time, the energy distribution within the cavity is more uniform. Other similar arrangements for the same purpose include rotating blades (U.S. Pat. No. 3,692,967), a rotating plate (U.S. Pat. No. 2,909,635), rotating slotted discs (U.S. Pat. No. 3,746,823) and rotating cylinders (U.S. Pat. No. 3,439,143).

In addition to the non-uniformity caused by the particular electric field mode established within the cavity, an additional non-uniformity results from the effects of the food mass being cooked on the distribution of energy within the cavity. More specifically, food is cooked within a microwave oven cavity by absorption of energy reflected from the walls of the cavity. A relatively small mass of food, if centered within the cavity, will be exposed to substantial reflections from all the walls of the cavity. In particular, such small food masses will not only receive direct and reflected energy on the portions thereof facing the feed means, but also will absorb a substantial amount of energy reflected from cavity walls on the opposite side of the cooking cavity from the feed means. The absorption of energy from walls opposite to the microwave energy feed entrance is particularly important in obtaining uniform cooking.

On the other hand, when large food masses such as a large roast are cooked, only a very small amount of energy reflected from the walls of the cavity opposite the feed passage reaches the food. Since energy is attenuated to a great extent by relatively large absorption on the sides of the large food mass nearest the feed opening, only a little is available for reflection from the opposed walls. The result is a food mass which is cooked in a non-uniform manner, i.e. cooking which is non-uniform throughout the mass of the food.

A similar problem is associated with two-shelf cooking arrangements in microwave ovens, since energy to the food on the lower shelf (assuming top feed means) is substantially reduced because the food on the top shelf intercepts a disproportionate share of the available microwave energy.

One attempt to solve this problem is shown in U.S. Pat. No. 2,909,635 in which the waveguide feeding the cooking cavity is designed to have two branches, a first feeding the upper portion of the cavity and a second feeding the lower portions thereof. Energy splitting means are provided in the waveguide to separate the electromagnetic energy into two unequal portions. This approach requires a substantial redesign of the waveguide structure of the microwave oven and is incompatible with a conventional single opening feed system. U.S. Pat. No. 3,320,396 teaches a similar approach to using a dual branched waveguide, but utilizes an antenna feed instead of an aperture for introducing microwave energy into the cavity.

OBJECTS AND SUMMARY OF THE INVENTION

Accordingly, it is the general object of this invention to provide new and improved microwave oven cooking apparatus.

A further object is the provision of a microwave oven cooking appliance capable of more uniform cooking of large food masses placed within the cooking cavity.

A further object is the provision of a microwave cooking appliance having a single aperture microwave energy feed opening, and waveguide distribution devices within the cooking cavity for impinging microwave energy into large food masses in a more uniform fashion.

Yet a further object is to provide a microwave oven cooking cavity which is divisible into separate subcavities by a support shelf and waveguide means within the cavity for coupling microwave energy from the subcavity nearest the feed aperture to the subcavity more remote therefrom to promote uniform cooking of large food masses.

These and other objects are accomplished in a microwave oven cooking appliance in which vertically oriented waveguides are arranged on opposed sides of the oven cavity. These waveguides operate to carry microwave energy from areas of the cavity adjacent a feed aperture to areas remote therefrom, thereby providing more uniform cooking of large food masses by bypassing a portion of the microwave energy around such food masses. The waveguides may be provided with formations for concurrently supporting a shelf which operates to define two subcavities. Each of the waveguides has open ends which terminate in each of the subcavities so as to transmit energy from the subcavity nearest the microwave feed aperture into the subcavity more remote therefrom. A microwave energy directing plate is mounted adjacent the feed aperture to direct microwave into the nearest open ends of the waveguides.

BRIEF DESCRIPTION OF THE DRAWINGS

The invention, both as to its organization and the principles of operation, together with further objects and advantages thereof, will best be understood by reference to the following specification taken in conjunction with the accompanying drawings in which.

DESCRIPTION OF THE PREFERRED EMBODIMENTS

Figure 1:
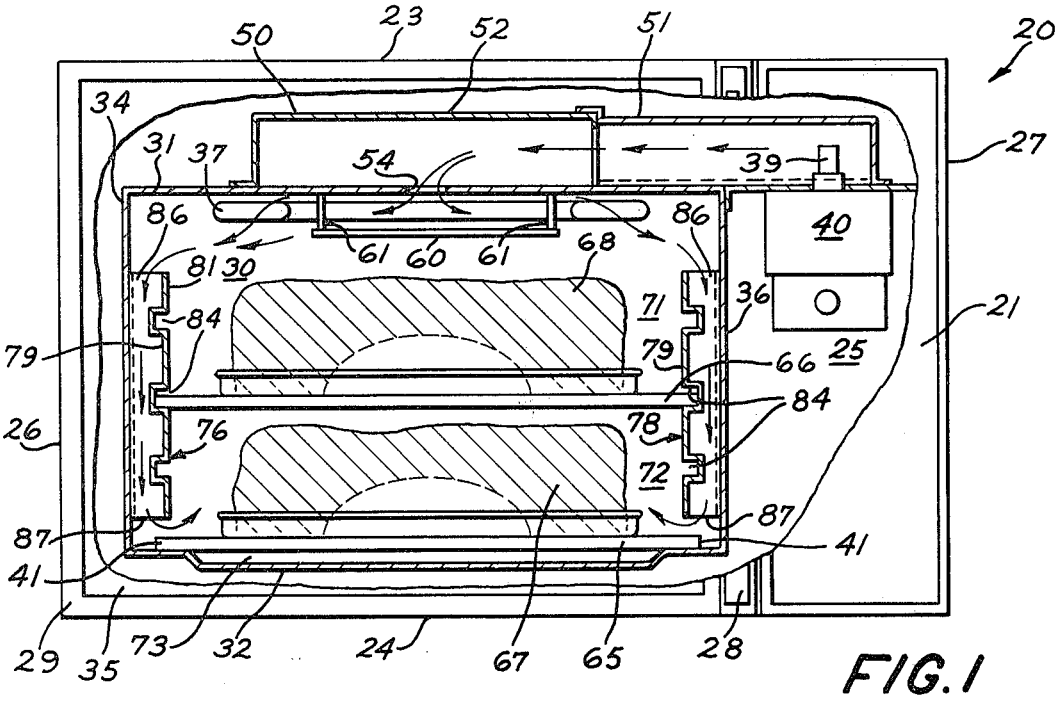
FIG. 1 is a schematic illustration of an oven embodying the principles of the invention and showing in vertical section an oven cavity including the waveguide microwave energy feed and distribution devices.
Figure 2:
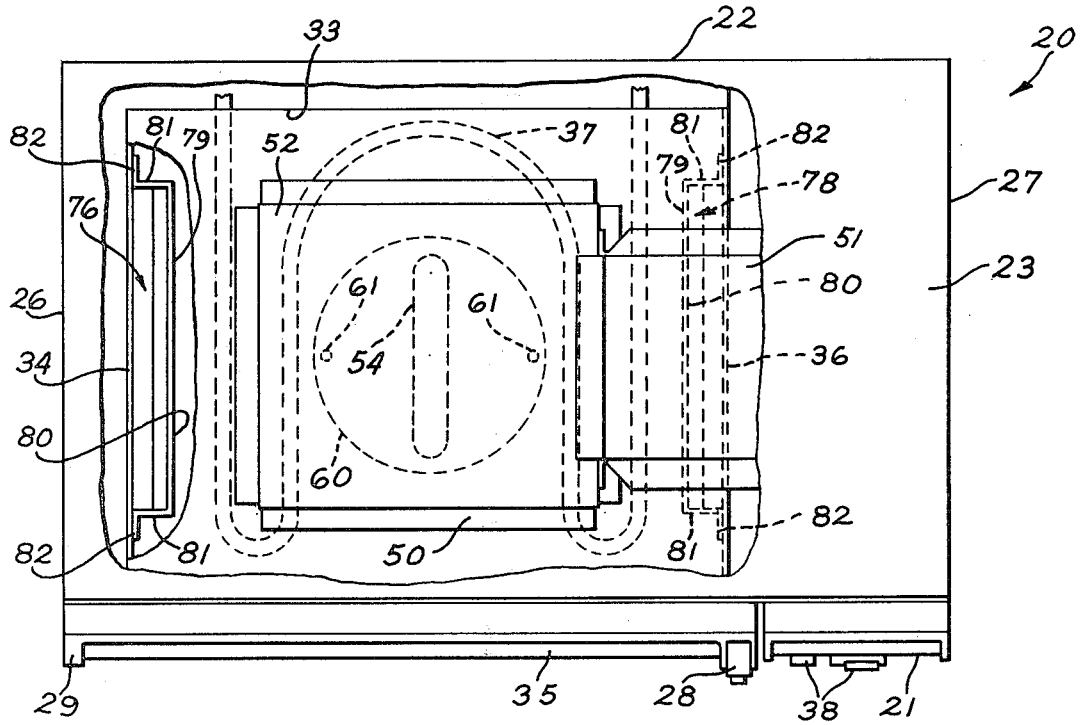
FIG. 2 is an elevational view of the oven of FIG. 1.

Referring now in particular to FIGS. 1 and 2 of the drawings, there is illustrated a microwave oven generally designated by the numeral 20, constructed in accordance with and embodying the features of the present invention. The microwave oven 20 is adapted for placement on top of a table or counter and is housed in a cabinet which includes an upstanding front panel 21, a rear wall 22, a top wall 23, a bottom wall 24 and a pair of opposed sidewalls 26 and 27. Mounted within the oven cabinet alongside the front panel 21 is a heating enclosure or cooking cavity, generally designated by the numeral 30, including a top wall 31, a bottom wall 32, a rear wall 33 and a pair of opposed sidewalls 34 and 36. The front of the heating enclosure 30 is closed by a door 35 which, in the closed position thereof, forms the front wall of the heating enclosure 30, which enclosure is generally in the form of a rectangular parallelepiped. The door 35 includes a handle 28 and is hinged on the side 29 thereof to allow for easy access to the oven cavity 30. The panel 21 is provided with control knobs 38 for operating the oven.

Thus, the interior of the oven cabinet is constructed to include a cooking cavity 30 defined by walls 31, 32, 33, 34 and 36 within the oven cavity and an electrical control compartment between the heating enclosure 30 and the oven cabinet walls 22, 23, 24 and 27.

The walls 31, 32, 33, 34 and 36, as well as the interior wall of door 35, are made of a conductive material so as to confine the microwave energy within cavity 30. The oven door 35 is also provided around the inner periphery thereof with a conventional microwave energy seal (not shown) to prevent the escape of microwave energy from the heating enclosure 30 in use.

Mounted in the machinery compartment 25 is a magnetron 40 which is adapted to produce microwave energy having a frequency of approximately 2450 MHz at the output probe 39 thereof when coupled to a suitable source of power. Microwave energy is fed from the magnetron 40 to the oven cavity 30 through a coupling means, such as a waveguide 50, although other forms of coupling may be used. The waveguide 50 includes a first section 51 adjacent the magnetron probe 39, and a second section 52 adjacent and centered over a centrally located feed opening or passage 54 in the top wall 31 of the cooking cavity 30. A so-called mode stirrer (not shown) may be mounted in the chamber formed by section 52 and top wall 31 to continuously change the mode patterns propagated into the cavity 30. The feed passage 54 is shown as being physically open but may be closed with any material known in the art to be pervious to microwave energy. The waveguide 50, including the sections 51 and 52 and the mode stirrer (not shown), is conventional in construction and is described in greater detail in U.S. Pat. No. 4,144,436.

Further, in accordance with the present invention, a flat non-absorbing conductive plate 60 is provided, supported within the cavity 30, spaced from the top, bottom and side walls of the cavity and maintained parallel to the top wall 31. The plate 60 is supported from the top wall 31 on insulating spacers 61 to which it is fastened by any suitable means, such as by screws. The plate is circular in shape and is positioned juxtaposed the opening 54 to substantially obstruct the direct path from the waveguide 50 through the opening 54 and into the cooking cavity 30. Plate 60 may be constructed of steel aluminum or any other metal. It should be understood that the plate 60 may take various other forms such as rectangular, square, etc., so long as it operates to substantially prevent direct impingement of microwave energy on the food contained in the oven cavity and to redirect this energy generally in the manner outlined hereinafter.

For food surface browning, a resistance heating or browning unit 37 is supported in a conventional manner from one of the vertical walls of the oven cavity adjacent the top wall 31, and in a plane parallel thereto. The browning unit 37 is of the conventional sheathed electrical resistance heating type and generally comprises a spiralled electrical resistance wire encased in an elongated ceramic filled metal outer sheath, the outer sheath portion being visible in FIG. 1. The exact configuration taken by the unit 37 may vary from a single loop to a multiloop or serpentine configuration. The ends of the browner unit 37 are suitably terminated in the rear wall, the electrical leads (not shown) therefrom being connected to suitable circuitry (not shown) for applying electrical power to heat the unit.

Two support shelves 65 and 66 made of microwave previous material are provided on which food loads 67 and 68 are supported. The shelf 66 has the effect of creating two subcavities or cooking areas, a first subcavity 71 located between the support shelf 66 and the top wall 31 in the upper portion of the cavity 30, and a second subcavity 72 located below the shelf 66 in the area between the shelf 66 and bottom wall 32. The shelf 65 is directly supported from bottom wall 32 along peripheral portions 41 thereof and is spaced from a recessed portion of the bottom wall 32 to define a space 73. The space 73 acts to increase the reflection of microwave energy from the bottom wall 32 toward food contained within the oven cavity.

A pair of bypass or coupling waveguides 76 and 78 extend vertically along each of the sidewalls 34 and 36, respectively. Each of the waveguides 76 and 78, as shown, is formed by attaching a formed sheet metal section 79 to one of the side walls. Each section 79 includes a base 80 from which two legs 81 extend, the legs being provided with flanges 82 which extend parallel to and in contact with the side walls for the purpose of attaching the section 79 to the sidewalls as by welding, brazing or other appropriate means. The base of each section 79 may be provided with slots 84 for supporting the shelf 66 at various heights within the cavity 30.

Each of bypass waveguides 76 and 78, as shown in FIGS. 1 and 2, comprises microwave transmissive ports or openings 86 and 87 at opposed ends thereof. The open end or port 86 is located near the top of the cooking cavity adjacent the top wall 31, while the other port 87 is located near the bottom of the cavity adjacent bottom wall 32. More specifically, each of the waveguides serves generally to couple microwave energy from the top portion of the cavity to the bottom portion thereof. Once delivered to the bottom portion of the cavity the microwave energy eventually reaches the food from below by reflection from the bottom wall 32 or lower portions of the sidewalls 34 or 36. as alluded to previously, once delivered to the bottom portion of the cavity a relatively greater amount of microwave energy tends to reach the lower and center portions of food mass 67 by means or reflections set up from the indented portion of bottom wall 32. When used with a shelf 66, the waveguides operate to couple energy from the subcavity 71 formed above the shelf 66 to the subcavity 72 below the shelf 66.

In order to obtain optimum impedance matching, the length of the by-pass waveguides is preferably selected to be approximately $N\lambda_g/2$, where N is an integer and $\lambda_g$ is the guide wavelength of the waveguide. The width of the by-pass waveguides is made equal to integer multiples of the half cutoff wavelength of the principle oven mode in the oven cavity waveguide. The thickness of the bypass waveguides is selected to be adequate to support the shelf (assuming a shelf is employed) and food to be placed thereon while concurrently providing sufficient clearance to prevent arcing between the base 80 and adjacent the oven cavity side wall. Of course, if no shelf is to be used the section of the bypass waveguides is planar in shape.

In operation, microwave energy originating at the magnetron 40 is transmitted along the waveguide 50 and enters the cooking cavity 30 through feed aperture 54. Instead of impinging directly on the food within the cavity, the energy is directed by reflections between the plate 60 and top wall 31 generally as shown by the arrows in FIG. 1 outwardly along the top wall 31 and then downwardly via the bypass waveguides 76 and 78. In this manner, a portion of the microwave energy is first presented to the food mass from below, rather than from above. More specifically, by means of the bypass waveguides a portion of the microwave energy is coupled directly to the subcavity 72 bypassing, in effect, subcavity 71. The result is a greater presentation of microwave energy to the lower portions of the food masses 67 and 68 and a more uniform cooking of these masses.

This advantage is illustrated in FIG. 1. Assuming the absence of the bypass waveguides 76 and 78, large food masses 67 and 68 placed in a microwave oven for cooking exhibit a cooking profile as shown in FIG. 1 wherein the cross hatched portions of the food masses represent areas of greater absorption of energy (and, consequently, greater doneness) as compared to the portions of the food masses below the dotted lines. With bypass waveguides according to the invention incorporate into the microwave oven a greater uniformity of cooking throughout the food mass is achieved.

While a specific embodiment of the invention has been illustrated and described herein, it is realized that numerous modifications and changes will occur to those skilled in the art. For example, the bypass waveguides need not be provided with slots 84 to support an oven shelf, if no shelf is to be provided in the oven. Likewise, the use of a reflector plate 60 is supportive of the function of the bypass waveguides, but it is not necessary to realize the energy coupling advantages of the waveguide to improve cooking uniformity when large food masses are cooked.

If the use of a solid plate 60 results in a reversal of the cooking profile due to the lack of direct impingement of microwave energy on the food from above, the plate 60 may be modified accordingly to allow a portion of the energy entering the cavity through the aperture 54 to travel directly to the food. The degree to which such modification of plate 60 may be needed to provide for direct exposure of food will vary as a function of the specific dimensions of the cooking cavity and the characteristics of the energization system.

Since numerous changes may be made in the above described apparatus, and different embodiments of the invention may be made without departing from the spirit thereof, it is intended that all matter contained in the foregoing description or shown in the accompanying drawings shall be interpreted as illustrative and not in a limiting sense.

What is claimed is:

1. A microwave cooking appliance comprising a cooking cavity for receiving objects to be heated, including a top wall, a bottom wall, a pair of side walls, and a front wall defined by a front opening access door, a source of microwave energy located externally of said cooking cavity, a microwave feed passage formed externally of said cooking cavity for introducing microwave energy from said source into said cooking cavity, a support self for defining separate cooking areas in said cooking cavity on opposite sides of said shelf, and a pair of rectangular waveguides entirely confined within said cooking cavity and arranged in a vertical plane supported from opposed side walls of said cooking cavity, opposed ends of each of said rectangular waveguides extending above and below said shelf, said waveguides each being operative independently of said shelf for coupling microwave energy from a first level spaced from one side of said shelf in one of said cooking areas to a second level spaced from the other side of said shelf in the other of said cooking areas.

2. The combination recited in claim 1 wherein each of said waveguides includes formations from which said shelf is supported.

3. The combination recited in claim 1 further including microwave energy directing means adjacent said feed passage for directing a portion of said microwave energy through said feed passage toward said waveguides.

4. The combination recited in claim 3 wherein said directing means comprises a conductive plate dielectrically supported from said cavity walls in a plane parallel to the top wall of said cavity opposite said feed passage.

5. The combination recited in claim 4 wherein said feed passage is arranged approximately centrally in said top wall.

6. A microwave oven cooking appliance comprising a box-like cooking cavity including by a top wall, sidewalls, bottom wall and front wall formed by a front-opening access door, a source of microwave energy, means for coupling microwave energy from said source into said cavity through a centrally located feed aperture in the top wall of said cavity, a food supporting shelf within said cavity, and a pair of rectangular waveguides carried by said sidewalls, oriented vertically in said cavity and having formations for supporting said shelf at a level above said bottom wall, said waveguides having energy transmissive ports located at opposed ends thereof, said waveguides being operative to receive microwave energy from said cavity into one port at a first vertical level within said cavity and couple said energy to a second vertical level in said cavity via said second port.

7. The combination recited in claim 6 further including microwave energy directing means for directing energy entering said cavity through said feed aperture toward said waveguides.

8. The combination recited in claim 7 wherein said feed aperture is located in said top wall, and said directing means comprises a conductive plate located parallel to said top wall opposite said feed aperture.

9. The combination recited in claim 8 wherein said plate is circular in shape and prevents the direct impingement of microwave energy on food within said cavity without reflection from a wall of said cavity.

* * * * *